United States Patent [19]

Boissevain

[11] Patent Number: 4,768,433

[45] Date of Patent: Sep. 6, 1988

[54] HOT AIR CALENDER ROLL CONTROLLER

[75] Inventor: Mathew G. Boissevain, Cupertino, Calif.

[73] Assignee: Measurex Corporation, Cupertino, Calif.

[21] Appl. No.: 694,855

[22] Filed: Jan. 25, 1985

[51] Int. Cl.[4] ..... B30B 15/34

[52] U.S. Cl. ..... 100/93 RP; 100/47; 100/162 B; 100/170; 29/113.2; 219/10.71

[58] Field of Search ..... 100/38, 47, 93 R, 917, 100/162 B; 219/10.41, 10.43, 10.57, 10.61 R, 10.71, 10.73; 34/48, 54; 165/2; 29/116 AD, 113 AD

[56] References Cited

U.S. PATENT DOCUMENTS

| | | | |
|---|---|---|---|
| 2,981,175 | 4/1961 | Goyette . | |
| 3,177,799 | 4/1965 | Justus et. . | |
| 3,203,678 | 8/1965 | Sawyer et al. . | |
| 3,266,561 | 8/1966 | Beachler et al. | 100/162 B |
| 3,702,912 | 11/1972 | Greenberger . | |
| 3,770,578 | 11/1973 | Spurrell . | |
| 4,114,528 | 9/1978 | Walker . | |
| 4,384,514 | 5/1983 | Larive et al. . | |
| 4,425,489 | 1/1984 | Pav et al. . | |
| 4,545,857 | 10/1985 | Wells | 34/54 X |

FOREIGN PATENT DOCUMENTS

| | | | |
|---|---|---|---|
| 211003 | 10/1957 | Australia | 100/93 RP |

OTHER PUBLICATIONS

Pulp & Paper Magazine, Nov. 1984, pp. 54–55.
Pulp & Paper Magazine, Dec. 1984, p. 157.

*Primary Examiner*—Peter Feldman
*Attorney, Agent, or Firm*—Spensley Horn Jubas & Lubitz

[57] ABSTRACT

A device for controlling the diameter of cylindrical sections of a rotating calender roll. The device comprises at least one nozzle which directs a jet of air against the calender roll. The flow of air from each nozzle remains approximately constant. Only the temperature of the jets change as heating elements associated with each nozzle are energized or deenergized. Thermal expansion or contraction, resulting from localized heating or cooling by the air jets, corrects local non-uniformities in the calender roll diameter.

7 Claims, 3 Drawing Sheets

HOT AIR CALENDER ROLL CONTROLLER

BACKGROUND OF THE INVENTION

The present invention relates to the field of calenders, and more particularly to devices for controlling the diameter of the rolls used in calenders or analagous machines.

Pressing a material between two calender rolls can change the physical characteristics of the material. For example, calendering paper changes its density, thickness and surface features. Thus, the calendering process is frequently used to manufacture paper and other sheet materials.

A common problem associated with calendering is the uneven thickness of the calendered material, or "web". Localized variations in the diameter of individual calender rolls creates variations in the spacing or "nip" formed between cooperating rolls. Variations in the nip across the width of a pair of calender rolls produces a web having non-uniform thickness. Therefore, a more uniform thickness can be attained by controlling the local diameter of the rolls.

If the rolls are made of a material that responds to changes in temperature by changing at least one dimension, one may control local roll diameters by varying the temperature of selected cylindrical sections of the calender roll. Previous devices have used this principle by directing jets of hot or cold air against sections of a rotating calender roll to control its local diameters.

Many of these devices blow jets of hot air from a supply plenum against selected sections of the calender roll to increase its local diameter and thus decrease the local thickness of the web. Alternatively, when these devices blow jets of cold air from a separate supply plenum against selected cylindrical sections of the calender roll, the adjacent sections contract. This decreases the local roll diameter and increases the local thickness of the web.

Nozzles communicating with the interior of each plenum direct these jets of air against the calender roll. The nozzles are disposed at intervals corresponding to adjacent sections of the calender roll whose local diameter is to be controlled. Examples of such devices are shown in U.S. Pat. No. 2,981,175 to Goyette, U.S. Pat. No. 3,177,799 to Justice and U.S. Pat. No. 3,770,578 to Spurrell.

Valves have often been used to control the flow of air through each nozzle. Where separate plenums provide the hot air and cold air, many such devices require two valves and two nozzles to control the diameter of each section of the calender roll. Alternatively, a dual control mechanism may be used to mix the relative volumes of hot and cold air from the two plenums and then release the air through a single nozzle. In either configuration, this redundancy can increase the cost of of these devices.

Another problem experienced with controllers of this type is that accurate control of the roll diameter can require precise metering of the air jets. Therefore, the valve control mechanisms generally should not exhibit hysteresis effects so that they can obtain repeatable settings regardless of whether the valve is being opened or closed. Furthermore, these control mechanisms usually must be capable of operating at high or low temperatures. However, even when the valves work properly and the control mechanisms accurately control the size of the valve orifices, the rate that air is released through the nozzles is often variable because the air pressure in each plenum depends upon both the number of valves open at one time and the volume of air released through each nozzle. Thus, the flow of air through the nozzles in these devices can be difficult to control.

These devices are also subject to other limitations and inefficiencies. For example, the nip control range is a function of the maximum and minimum temperatures of the air jets. However, the hot air in the plenum is typically heated by waste steam from the facility power plant. Steam supplied by such a power plant usually has a maximum temperature of about 350° F., and inefficiencies in the heat exchange process further limit the maximum temperature of such steam heated air to about 325° F.

Furthermore, to maintain the air temperature at 325° F., hot air must be continuously supplied to the hot air plenum, even when hot air is not being released through the nozzles. If hot air is not continuously supplied to the hot air plenum, the stagnant air in the plenum may cool to ambient temperature. Then, when a jet of hot air is required to increase the diameter of a section of the calender roll, the cooled stagnant air must first be purged from the plenum. This increases the response time of the device.

The calender roll control device of the present invention has a number of features which overcome many of the disadvantages of calender roll control devices heretofore known. It can provide a constant flow of air from a single plenum and it can accurately adjust the temperature of a plurality of air jets. Since it requires only one plenum and can operate without flow control mechanisms, the device has a relatively low initial cost. Additionally, it does not require steam heating equipment. Instead, the device heats the air jets only where and when necessary to increase the roll diameter. Furthermore, because it produces hotter air jets than are typically provided by steam powered equipment, the device of the present invention can provide more than twice the nip control range on a typical 12" diameter 190° F. calender roll. These and other advantages will become apparent in the description which follows.

SUMMARY OF THE INVENTION

The present invention is directed to controllers for controlling local calender roll diameters by directing jets of hot or cold air against selected cylindrical sections of a rotating calender roll. The roll is made of a material that responds in at least one dimension to changes in temperature. Thermal expansion or contraction, resulting from localized heating or cooling by the air jets, corrects local nonuniformities in the calender roll diameter.

In the illustrated embodiments, the invention comprises a single elongated cold air plenum positioned alongside a calender roll. A plurality of nozzles, disposed along the length of the plenum, direct jets of air at cylindrical sections of the roll. Heating elements, such as electrical resistive heaters, are positioned within or adjacent each nozzle. Therefore, when the heating elements are energized, the cold air escaping through the nozzles is heated by contact with the heating elements. It is recognized, however, that other types of heating devices may be used.

A sensor measures the thickness of the web and power to the heating elements is adjusted to maintain a uniform thickness. The volume of air emitted by each nozzle can remain substantially constant. Only the temperature of the air jets need change as the heating elements are energized or de-energized in response to signals from the web thickness sensor.

BRIEF DESCRIPTION OF THE DRAWINGS

Like reference numbers in the various figures refer to like elements.

DETAILED DESCRIPTION OF THE PREFERRED EMBODIMENTS

Figure 1:
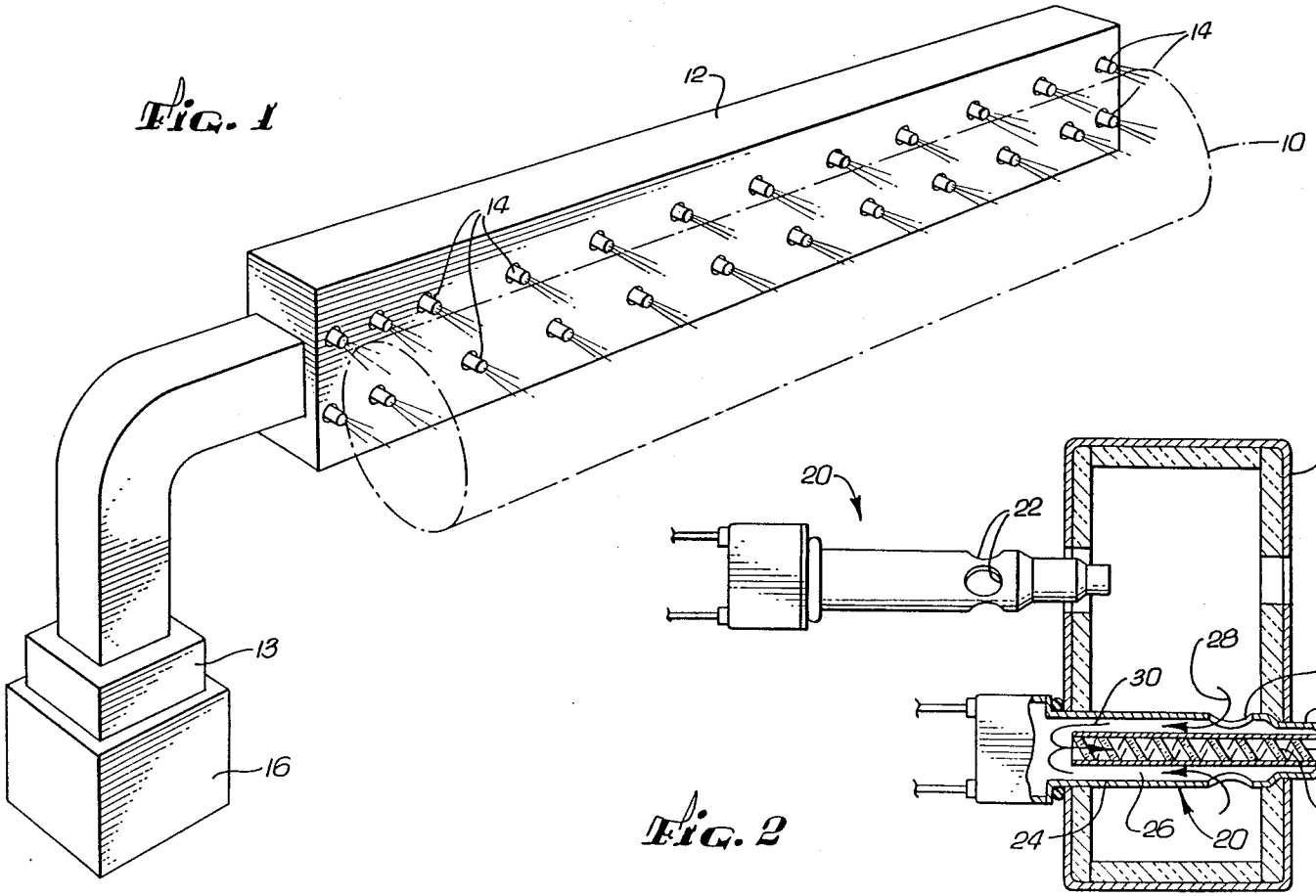
FIG. 1 is a perspective view of one embodiment of the present invention showing a plurality of nozzles disposed along the length of the plenum and directing air against a calender roll.

In one embodiment of the present invention, illustrated in FIG. 1, the calender roll control apparatus extends alongside a roll 10 of the calendering device. The apparatus comprises a cold air plenum 12 and a plurality of nozzles 14 dispersed along the length of the plenum 12 and communicating with its interior. A fan 13 pressurizes the plenum 12 with air. This pressurized air may be optionally preheated or cooled by any of a variety of well known devices 16 for heating or cooling air. The pressurized air in the plenum 12 escapes through the nozzles 14 which direct the air against sections of the calender roll 10 to control its diameter. An additional row of nozzles 14 is disposed near the ends of the plenum 12 to compensate for the increased tendency of the calender roll 10 to cool at its ends.

Figure 2:
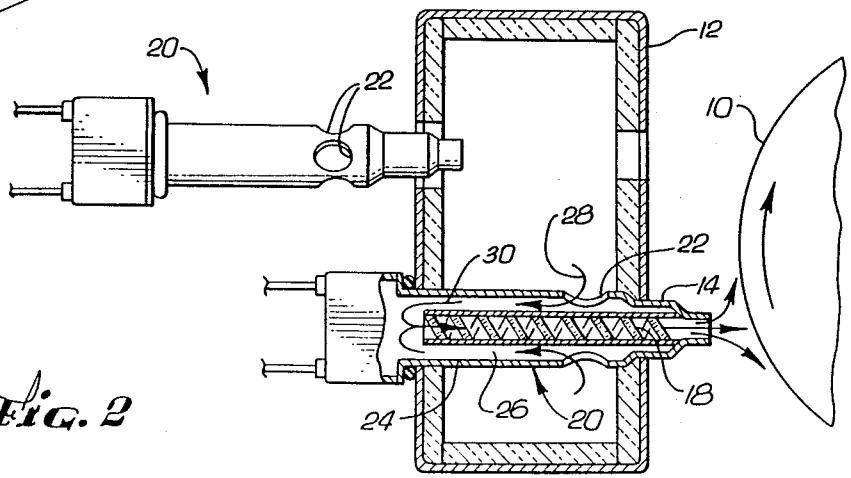
FIG. 2 is a cross-sectional view of the embodiment illustrated in FIG. 1 showing removable heating modules.

FIG. 2 is a more detailed cross-sectional view of the device illustrated in FIG. 1. At least one electrical heating element 18 is disposed within every nozzle 14 and each nozzle 14, with its internal heating element 18, comprise a unitary heating module 20. As shown in FIG. 2, these modules 20 are detachable from the plenum 12 for convenient repair, inspection or replacement. In FIG. 2, the upper heating module is shown detached from the plenum 12.

Air from the plenum 12 enters the heating module 20 through holes 22 in the module casing 24 provided for this purpose. The air then flows through a channel 26 toward the rear of the heating module 20 where it enters the interior of the nozzle 14. Arrows 28, 30 illustrate the flow path of the air. Air passing through the nozzle 14 contacts the heating elements 18. Therefore, although cold air in the plenum 12 escapes at a constant rate through each nozzle 14, the temperature of the escaping air can be elevated by energizing the heating elements 18.

Figure 3:
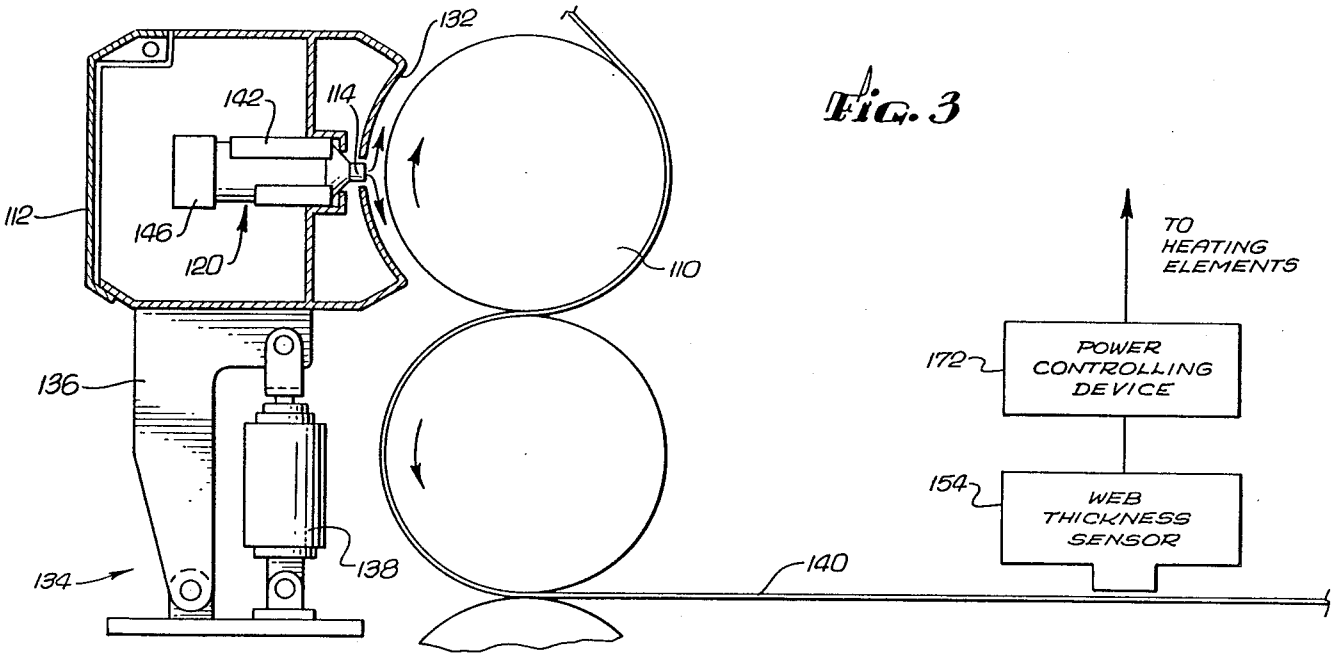
FIG. 3 illustrates another embodiment of the present invention having a single row of nozzles directed against a calender roll and a shroud for preventing cold air entrainment. This embodiment is supported by an over-center support mechanism.

FIG. 3 illustrates a second embodiment of the present invention. It operates in substantially the same manner as the first embodiment. However, in this embodiment, pressurized air from the plenum 112 enters the rear of the heating module 120 and flows directly through the nozzle 114 toward the calender roll 110. Additionally, the nozzles 114 protrude from a concave shroud 132 which acts to constrain the air emitted by the nozzles 114 so that the air remains in contact with the calender roll 110, thus enhancing the efficiency of heat transfer to or from the roll 110. The shroud 132 also prevents cold ambient air from being entrained by the air jets. This would reduce tne effective temperature of the jets. Of course, a similar shroud 132 could be used with the embodiment of the invention illustrated in FIG. 1 and FIG. 2.

The calender roll control device of FIG. 3, is shown supported by an over-center support mechanism 134. This mechanism comprises two rigid pivotable arms 136. The arms 136 are disposed at either end of the plenum 112. These arms 136 support the plenum 112 so that the plenum 112 and shroud 132 are pivotable toward or away from the calender roll 110.

An extendible air cylinder 138 is associated with each pivotable arm 136. Pressurizing the cylinders 138 with air causes them to expand, thus rocking the plenum 112 away from the calender roll 110. In the operating position, however, each air cylinder 138 is pressurized so that the nozzle 114 and shroud 132 are positioned approximately ½ inch to approximately 2 inches from the surface of the calender roll 110 depending upon the application and the calender roll control device leans slightly toward the calender roll 110. In this metastable position, if the web 140 breaks and wraps around the roll 110, a slight forceful contact between the web 140 and the nozzles 114 or shroud 132 will be sufficient to rock the device back away from the calender roll 110 and thus avoid damage to the device.

Figure 4:
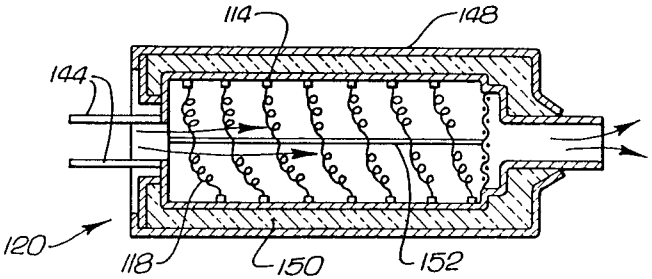
FIG. 4 is a detailed illustration of a heating module usable with the embodiment of FIG. 3.

FIG. 4 is a detailed view of a heating module 120 which is usable with the embodiment of the present invention illustrated in FIG. 3. This heating module 120 fits into the heating module socket 142 shown in FIG. 3. Two conducting elements 144 extend from the rear of the heating module 120 and plug into an electrical socket 146 positioned within the plenum 112. The module 120 may also be easily unpluged for convenient inspection, repair or replacement.

The module comprises a nozzle 114 which tapers toward the front. This nozzle 114 is surrounded by a larger concentric outer tube 148. The space between the nozzle 114 and the outer tube 148 is filled with an insulating material 150.

The heating elements 118 are suspended on a thin mica frame 152 which has a low thermal mass. The low thermal mass of the heating elements 118 and mica frame 152 allow the temperature of the air jets to change rapidly in response to signals from the web thickness sensor 154.

Figure 5:
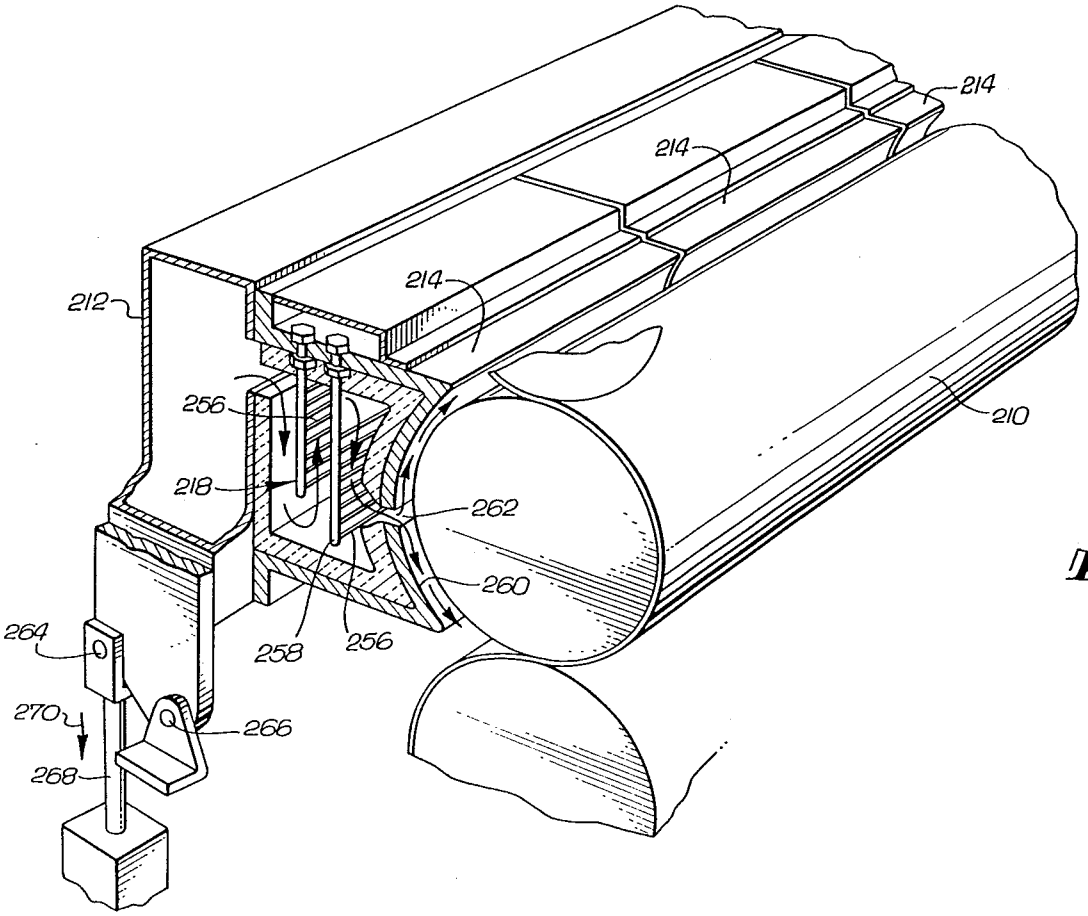
FIG. 5 is a cross-sectional plan view of another preferred embodiment of the present invention having a concave nozzle to prevent cold air entrainment.

FIG. 5 illustrates a third embodiment of the present invention. In this embodiment, pressurized air from the plenum 212 enters the rear of the nozzle 214 and flows through the nozzle 214 toward the calender roll 210. As in the first and second embodiments, each nozzle 214 contains internal heating elements 218 which may be used to heat the air as it flows through the nozzle 214. The heating elements 218 comprise lengths of resistive wire 256 strung between conductive posts 258 which are disposed at opposite ends of the nozzle 214. Each nozzle 214 is 10 inches long, however, the nozzles 214 may be longer or shorter depending upon the desired degree of nip control.

These nozzles 214 have concave ends 260 which conform to the surface of the calender roll 210. The concave nozzles 214 in this embodiment serve functions similar to the shroud 132 (see FIG. 3) in the second embodiment of the present invention. The concave ends 260 of the nozzle 214 constrain the air emitted from the nozzle orifice 262 so that it remains in contact with the calender roll 210 until the air emerges at the edge of the nozzle 214. Since the hot or cold air emitted from the orifice 262 remains in contact with the calender roll 210 for a longer period of time, more heat is transferred between the roll 210 and the air. Additionally, the concave nozzles 214 prevent cold ambient air from being entrained by the air jets. As previously mentioned, this would reduce the effective temperature of the jets.

The plenum 212 is pivotally mounted on pivots 264, 266. Pivot 264 is supported by an elongated member 268. When the member 268 retracts in the direction of the arrow 270, the plenum 212, nozzles 214, and heating elements 218 swing away from the calender roll 210. This permits convenient repair, inspection or replacement of the device.

Each embodiment of the present invention operates in substantially the same manner. Therefore, the operation of the device of the present invention will be described with reference to only the second embodiment illustrated in FIG. 3 and FIG. 4. However, the description which follows is also applicable to the other embodiments.

During operation of the invention, a sensor 154 measures the thickness of the web 140 and produces a signal corresponding to the measured thickness of each section of web 140. These signals are then fed to a power controlling device 172 which adjusts the power to the heating elements 118 to obtain a web 140 having uniform thickness. An example of a sensor controlled calender roll control device is shown in U.S. Pat. No. 4,114,528 to Walker.

Depending upon the degree of deviation of the web 140 from the desired thickness, more or less power is applied to the heating elements 118 in the nozzles 114 adjacent those sections of the calender roll 110 whose diameters are to be adjusted. The sections of the calender roll 110 producing too thick a web 140 are heated by energizing the heating elements 118 in an adjacent nozzle 114. The greater the amount of power applied to the heating elements 118, the more hot air impinges against the calender roll 110 and the more thermal expansion occurs. For example, with 1 psig plenum pressure and a 0.625 inch nozzle diameter, a 5.5 Kw heating element 118 will heat 65° F. air to 600° F. in about six seconds.

Alternatively, when the sensing device 154 detects a thin web section 140 the power controlling device 172 directs less power to the adjacent heating elements 118 or it turns these heating elements 118 completely off. As the power to the heating elements is decreased, the adjacent sections of calender roll 110 are subjected to a flow of colder air. The colder air causes the adjacent sections of the calender roll 110 to contract, thereby increasing the local nip spacing and producing a thicker section of web.

Many steam heated apparatuses for controlling the thickness of the calendered web 140 are limited to heating air to a maximum temperature of about 325° F. In contrast, the present invention can achieve air temperatures of 600° F. This higher temperature provides more than twice the control range on a typical 190° F., 12-inch roll 110. Additionally, since the air flow through every nozzle 114 remains constant, more accurate control is possible. The temperature of the air emerging from each nozzle 114 is independent of the temperature of the air emerging from the other nozzles 114.

Two preferred embodiments of the present invention have been described. Nevertheless, it is understood that one may make various modifications without departing from the spirit and scope of the invention. For example, instead of continuously varying the level of power to the heating elements, the power may be switched on and off for varying percentages of a duty cycle. Furthermore, nozzles of different shapes and sizes are not beyond the scope of the present invention. Thus, the invention is not limited to the preferred embodiments described herein.

I claim:

1. A roll diameter control system, comprising:

a first rotatable roll having an elongated cylindrical surface;

a plenum disposed alongside the cylindrical roll surface;

pressurizing means for pressurizing the plenum with a gas;

a plurality of nozzles in flow communication with the interior of the plenum for directing continuous jets of the gas from the plenum through each nozzle toward the cylindrical roll surface, said nozzles being disposed at intervals along the axial direction of the cylindrical surface;

a plurality of individually controllable electric heating elements, wherein each of said heating elements is adjacent to a nozzle for selectively heating the gas that flows through the adjacent nozzle, so that gas flowing through different nozzles can simultaneously have different temperatures;

at least one arm pivotally supporting the plenum;

a fixed member; and at least one extendible member, wherein one end of said extendible member is coupled to the arm at a location spaced from the pivot point of the arm and the opposite end of the extendible member is coupled to the fixed member so that the pivotal position of the arm is controlled by extending or retracting the extendible member.

2. A system for independently controlling the diameters of a plurality of axial sections of a axially elongated roll, the system comprising:

an elongated plenum having an elongated front wall, wherein a plurality of holes are formed in said front wall and spaced at intervals lengthwise along the wall;

means for pressurizing the plenum with air so that air flows out of the plenum through the holes;

a plurality of individually controllable electric air heating elements adjacent to each of the holes for heating the air flowing out of the plenum through each hole;

electric power supply means for selectively supplying electric power to each of the heating elements so that air flowing out of the plenum through different holes can simultaneously have different temperatures;

a rotatable roll having a elongated cylindrical surface and a diameter which changes with changes with temperature, said roll being disposed lengthwise along said elongated front plenum wall;

a sheet of calenderable material pressed against the cylindrical surface of the roll;

sensing means for sensing the thickness of the material at a plurality of locations across the width of the material and producing signals corresponding to the thickness of the material at each of said locations;

control means responsive to said signals for controlling the amount of electric power selectively supplied to each of the heating elements;

a support member;

at least one pivotable arm, one end of the arm being coupled to the plenum and the other end of the arm being pivotally mounted to the support member at a pivot point below the plenum; and at least one extendible member, wherein one end of the extendible member is coupled to the support member and the other end of the extendible member is coupled to the arm at a location along the arm spaced from the pivot point such that the pivotal position of the plenum is controlled by extending or retracting the extendible member, said extendible member being extendible to an extent such that the plenum tilts on the pivotable arm toward the roll to a position slightly past the balance point, so that a force exerted against the plenum in the direction away from the roll will rock the plenum over the balance point and away from the roll.

3. A system as in claim 1, wherein said one end of the extendible member is coupled to the arm at a location above the pivot point of the arm.

4. A system as in claim 2, wherein the heating elements are disposed inside the plenum.

5. A roll diameter control system for controlling the diameters of a plurality of axial sections of an axially elongated roll, the system comprising:

an elongated plenum having an elongated front wall, wherein a plurality of holes are formed in said front wall and spaced at intervals lengthwise along the wall;

means for pressurizing the plenum with fluid so that fluid flows out of the plenum through the holes;

heating means for heating the fluid which flows out of said holes;

at least one pivotable arm having a pivot point, said arm supporting the plenum above the pivot point; and at least one variable length member, wherein one end of the member is coupled to the arm at a location along the arm spaced from the pivot point such that the pivotal position of the plenum is controlled by varying the length of the member, the length of said member being variable to an extent such that the plenum can rest on the pivotable arm in a position slightly past the balance point and a force exerted against the front wall can rock the plenum over the balance point.

6. The system of claim 5, further comprising:

a rotatable roll having an elongated cylindrical surface and a diameter which changes with changes in temperature, said roll being disposed lengthwise along the elongated front plenum wall;

a sheet of calenderable material pressed against the cylindrical surface of the roll;

sensing means for sensing the thickness of the material at a plurality at locations across the width of the material and producing signals corresponding to the thickness of the material at each of said locations; and control means responsive to said signals for causing the heating means to selectively heat the fluid flowing out of each of said holes.

7. A roll diameter control system, comprising:

an elongated plenum having an elongated front wall, wherein a plurality of holes are formed in said front wall and spaced at intervals lengthwise along the wall;

means for pressurizing the plenum with fluid so that the fluid flows out of the plenum through the holes;

a rotatable roll disposed lengthwise along the elongated front wall;

at least one pivotable arm having a pivot point spaced from and below the plenum, said arm pivotally supporting the plenum so that the plenum may balance on the arm at one pivotal disposition, and further wherein the plenum can pivot on the arm from one side of the balanced disposition, wherein the plenum leans toward the roll, to the other side of the balanced disposition, wherein the plenum leans away from the roll; and means for halting the pivoting of the plenum on the arm at a disposition wherein the plenum leans toward the roll but is spaced from the roll so that a force applied to the front wall in the direction away from the roll will pivot the plenum through the balanced disposition and the plenum will pivot away from the roll.

* * * * *